US005971155A

United States Patent [19]

Liang

[11] Patent Number: 5,971,155

[45] Date of Patent: Oct. 26, 1999

[54] QUICKLY ACCESSIBLE AND FILLABLE PLASTIC BAG UNIT

[75] Inventor: Ching-Chung Liang, Taipei, Taiwan

[73] Assignee: Chen-Chi Chen, Hsien, Taiwan

[21] Appl. No.: 09/226,536

[22] Filed: Jan. 6, 1999

[51] Int. Cl.[6] ..... B65D 1/34

[52] U.S. Cl. ..... 206/554; 383/9; 383/37; 383/65

[58] Field of Search ..... 206/554; 383/35, 383/210, 63, 7, 37, 65, 9, 32; 248/95

[56] References Cited

U.S. PATENT DOCUMENTS

| | | | |
|---|---|---|---|
| 4,458,466 | 7/1984 | Carbone et al. | 53/390 |
| 5,100,000 | 3/1992 | Huseman | 206/554 |
| 5,226,858 | 7/1993 | Snowdon | 493/195 |
| 5,419,437 | 5/1995 | Huseman | 206/554 |

*Primary Examiner*—Paul T. Sewell
*Assistant Examiner*—Nhan T. Lam
*Attorney, Agent, or Firm*—Townsend and Townsend and Crew LLP

[57] ABSTRACT

A quickly accessible and fillable plastic bag unit includes a spacer unit having two layers, and a plastic bag having front and back walls which are joined together, and a pair of complementary separable zipper halves which are provided respectively on the front and back walls and which are spaced apart from the spacer unit at a predetermined distance. The plastic bag unit has an aperture unit formed through an intermediate portion of the spacer unit, two narrower outer uncut spaces which are respectively adjacent to the longitudinal sides of the plastic bag and which connect the spacer unit to the front and back walls, and two wider inner uncut spaces which are respectively adjacent to the aperture unit and which connect the spacer unit to the front and back walls. Each of the outer uncut spaces and an adjacent inner uncut space cooperatively define therebetween a slit line having a length which is longer than those of the uncut spaces. The slit line of the plastic bag is designed so that, upon application of a quick pulling force to a portion of the front wall adjacent to the aperture unit toward the zipper halves, the front wall separates from the spacer unit the wider inner uncut spaces, thereby subsequently separating the zipper halves from each other and finally separating the plastic bag from the spacer unit along the outer uncut spaces on the front wall and the uncut spaces on the back wall.

3 Claims, 5 Drawing Sheets

QUICKLY ACCESSIBLE AND FILLABLE PLASTIC BAG UNIT

BACKGROUND OF THE INVENTION

1. Field of the Invention

This invention relates to a plastic bag, more particularly to a plastic bag which can be quickly accessed and filled with products due to the provision of a special zipper unit and uncut spaces.

2. Description of the Related Art

For some retail occupations or industrial applications, it is quite often important that the plastic bags which are used to hold and store the products to be sold be quickly accessible and fillable so as to minimize the time required for manually filling the plastic bags with the products. In this regard, Huseman, U.S. Pat. No. 5,419,437 discloses bags which are suspendable on a stand. The suspendable bags are made of a plastic film and include a front wall and a back wall that are joined together, thereby forming a bag cavity therebetween. An opening is provided between the front and back walls leading to the bag cavity. Complementary separable zipper profiles are provided on the front and back walls at the opening, thereby making the plastic bag selectively openable and closable. A lip is attached and extends from the front wall above the zipper profiles. A header portion is attached and extends from the back wall above the zipper profiles, and apart of the header portion is suspended or supported on the stand for carrying the bag. A plurality of identical such bags may be stacked above one another and attached to one another at the header portion, thus creating a bag pad attached at the header portion. A perforation line is provided on the header portion between the part that is supported on the stand and the zipper profiles and, also, between the header part, whereat a plurality of identical bags are attached to one another and to each respective bag zipper. In the process of opening and placing products in the plastic film bag, the plastic bag pad is placed and supported on a stand. Initially, the complementary zipper profiles are attached to one another, and the bag opening is closed. The front wall lip is initially gripped by the operator and, thereafter, is pulled away from the bag header portion and the support stand, thereby separating the complementary zipper profiles and opening the bag. By subsequently pulling the lip away from the stand and the header portion, the bag is severed from the header portion at the perforation line and, thus, the operator has in hand an opened bag generally ready for placing products therein for filling the same. Thereafter, product is placed in the bag cavity through the bag opening and, finally, the complementary separable zipper profiles are joined, thereby closing the bag opening and sealing the product within the bag cavity.

The stand is adapted for suspending or supporting the suspendable bags thereon, and includes two upstanding walls connected together at their upper ends and a base portion connecting together the two lower ends of the upstanding walls and forming a generally A-frame structure. An arcuate support peg is located at the upstanding wall and is adapted to be received through the support holes of the suspendable bags which are formed in the back walls of the suspendable bags and which are located between the perforation lines and the zipper profiles of the suspendable bags.

However, the bag pad disclosed in the aforementioned U.S. patent still has the following drawbacks:

1. The extension of the arcuate support peg through the support holes of the bags is time-consuming. However, a situation in that the complementary zipper profiles are not separated after the bag is severed from the header portion may occur in the absence of the arcuate support peg.
2. To prevent the above mentioned problem, the strength of the perforation lines must be greater than the strength of the zipper profiles such that pulling on the lip first causes the zipper profiles to separate and thereafter causes the bag to be separated from its header portion. Since the strength of the perforation lines is determined in accordance with the pitch between two holes of the perforation lines, the pitch between two holes of the perforation lines has to be varied when the width of the bag is varied in order to ensure that the separation of the zipper profiles is prior to the separation of the bag from its header portion, thereby inconveniencing the manufacture of bags with different widths and increasing the manufacturing cost of the same.
3. In order to ensure that the pulling force or tension is experienced along substantially the entire length of the perforation lines during the initial pulling and prior to the separation of the zipper profiles so as to ensure that the separation of the zipper profiles is prior to the separation of the bag from its header portion, the bag's perforation lines are strategically placed sufficiently high enough with respect to the zipper profiles, thereby resulting in a waste of plastic material and in an increase in the manufacturing cost.

SUMMARY OF THE INVENTION

Therefore, the main object of the present invention is to provide a quickly accessible and fillable plastic bag which can overcome the drawbacks that are associated with the prior art.

According to the present invention, each of a plurality of stacked quickly accessible and fillable plastic bag units includes a spacer unit having two layers, and a plastic bag having a front wall and a back wall connected to the spacer unit. The front and back walls of the plastic bag are joined together and define a bag cavity therebetween. The plastic bag further includes a pair of complementary separable zipper halves which are provided respectively on the front and back walls and which are spaced apart from the spacer unit at a predetermined distance. The plastic bag unit has an aperture unit formed through an intermediate portion of the spacer unit, two narrower outer uncut spaces which are respectively adjacent to longitudinal sides of the plastic bag and which connect the spacer unit to the front and back walls of the plastic bag, and two wider inner uncut spaces which are respectively adjacent to the aperture unit and which connect the spacer unit to the front and back walls of the plastic bag. Each of the outer uncut spaces and an adjacent inner uncut space cooperatively define therebetween a slit line having a length which is longer than those of the inner and outer uncut spaces. The slit line of the plastic bag is designed so that, upon application of a quick pulling force to a portion of the front wall adjacent to the aperture unit toward the zipper halves, the front wall separates from the spacer unit at the wider inner uncut spaces, thereby subsequently separating the zipper halves from each other and finally separating the plastic bag from the spacer unit along the narrower outer uncut spaces on the front wall and the outer and inner uncut spaces on the back wall.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
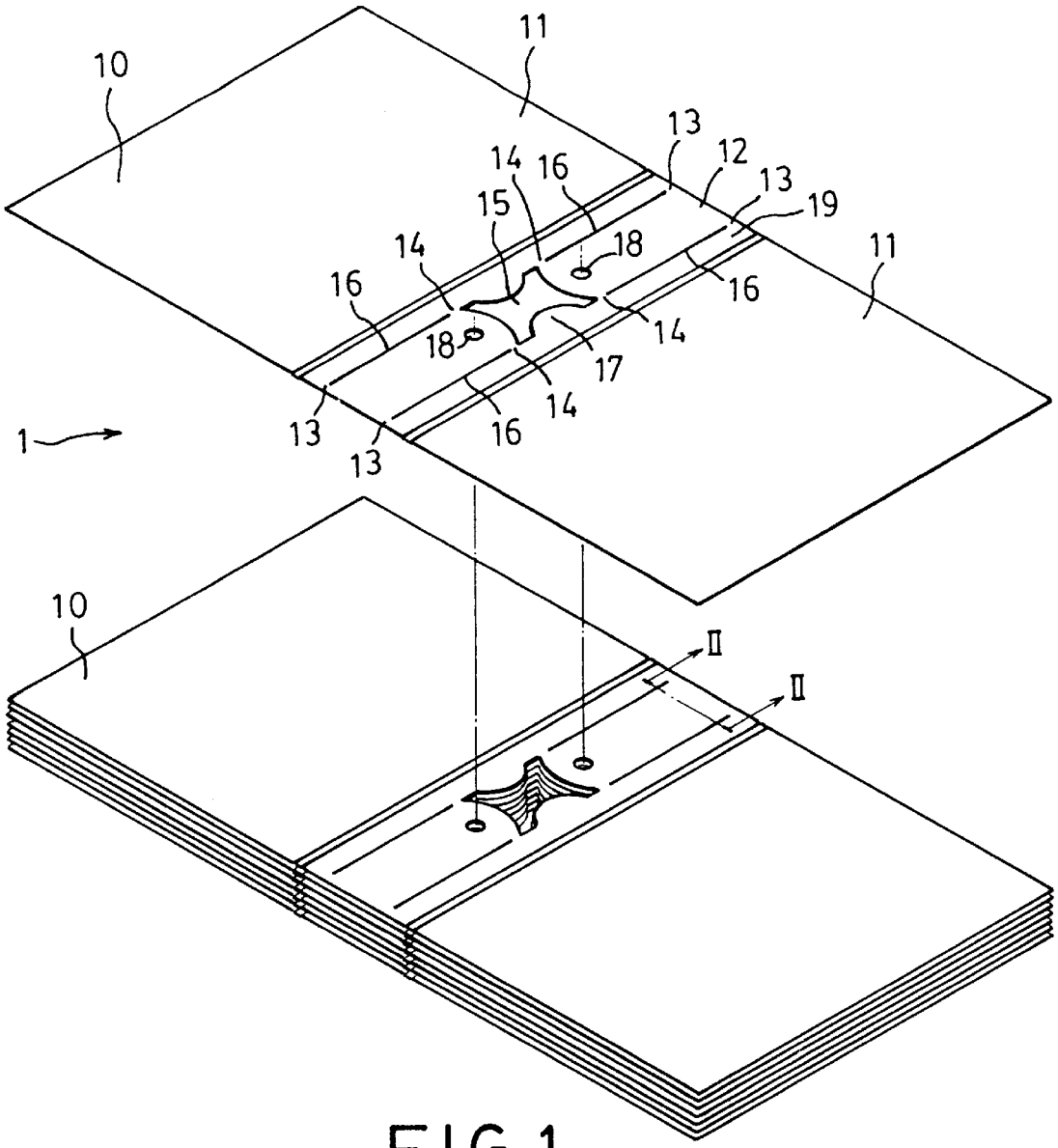
FIG. 1 is a perspective view of a plurality of stacked plastic bag units according to a first preferred embodiment of the present invention.

Before the present invention is described in greater detail, it should be noted that like elements are denoted by the same reference numerals throughout the disclosure.

Figure 2:
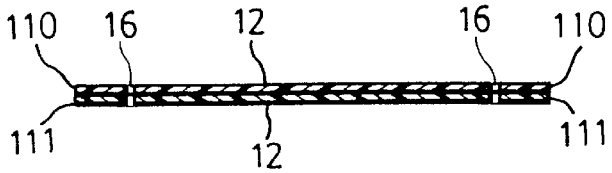
FIG. 2 is a sectional view taken along line II—II in FIG. 1.
Figure 5:
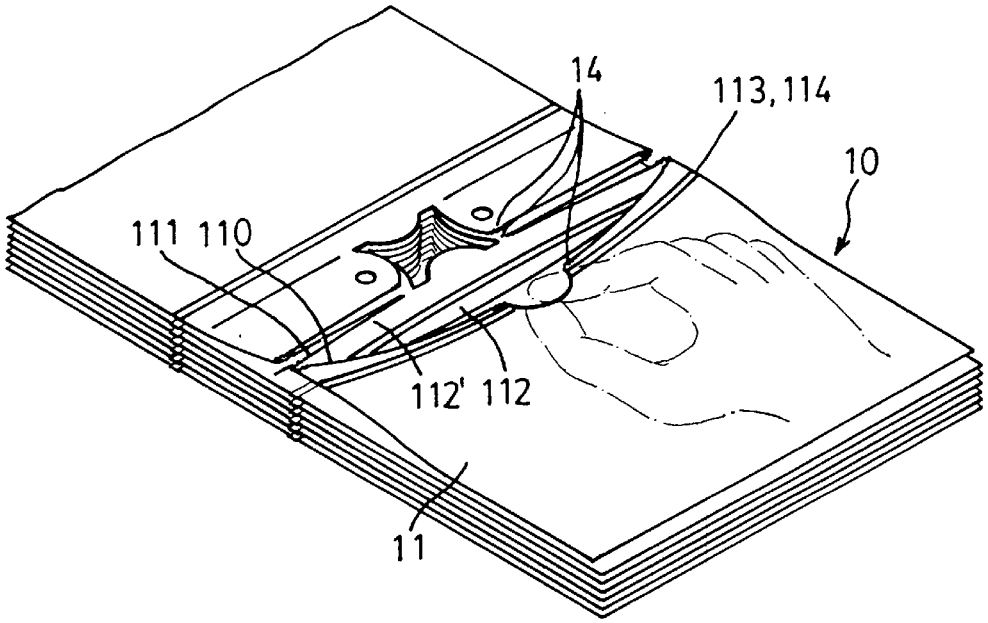

Referring to FIG. 1, a plurality of stacked plastic bag units 10 of a first preferred embodiment of the present invention is shown. Each of the bag units 10 includes a pair of plastic bags 11 and a spacer unit 12 which is located between and which interconnects the plastic bags 11. The spacer units 12 are attached to each other by thermal welding, in such a manner that two or more circular holes 18 are formed through the bag units 10 and that the bag units 10 are stacked. As shown in FIGS. 2 and 5, each of the plastic bags 11 has a front wall 110 and a back wall 111 which are joined together and which define a bag cavity 112 therebetween. Each of the plastic bags 11 further has a zipper unit consisting of a pair of complementary separable zipper halves 113, 114 which are provided respectively on the front and back walls 110, 111 and which are spaced apart from the corresponding spacer unit 12 at a predetermined distance.

In this embodiment, in each bag unit 10, the spacer unit 12 has two layers (as best shown in FIG. 2) and is connected to each of the front and back walls 110, 111 of the plastic bags 11 by means of two narrower outer uncut spaces 13 which are respectively adjacent to longitudinal sides of the bag unit 10, and two wider inner uncut spaces 14 which are respectively adjacent to two opposite sides of a generally H-shaped aperture unit 15 that extends across the middle portion of the spacer unit 12 and that is located between the circular holes 18. Each adjacent pair of uncut spaces 13, 14 defines a slit line 16 therebetween. Each of the front and back walls 110, 111 is integrally formed with a lip 17 which extends into the aperture unit 15. It should be noted that, in use, the stacked bag units 10 of the present invention are placed on a worktable (not shown). Alternatively, the stacked bag units 10 can be optionally attached to a support (not shown) by inserting posts (not shown) on the support (not shown) through the aperture units 15 and/or the circular holes 18.

Figure 3:
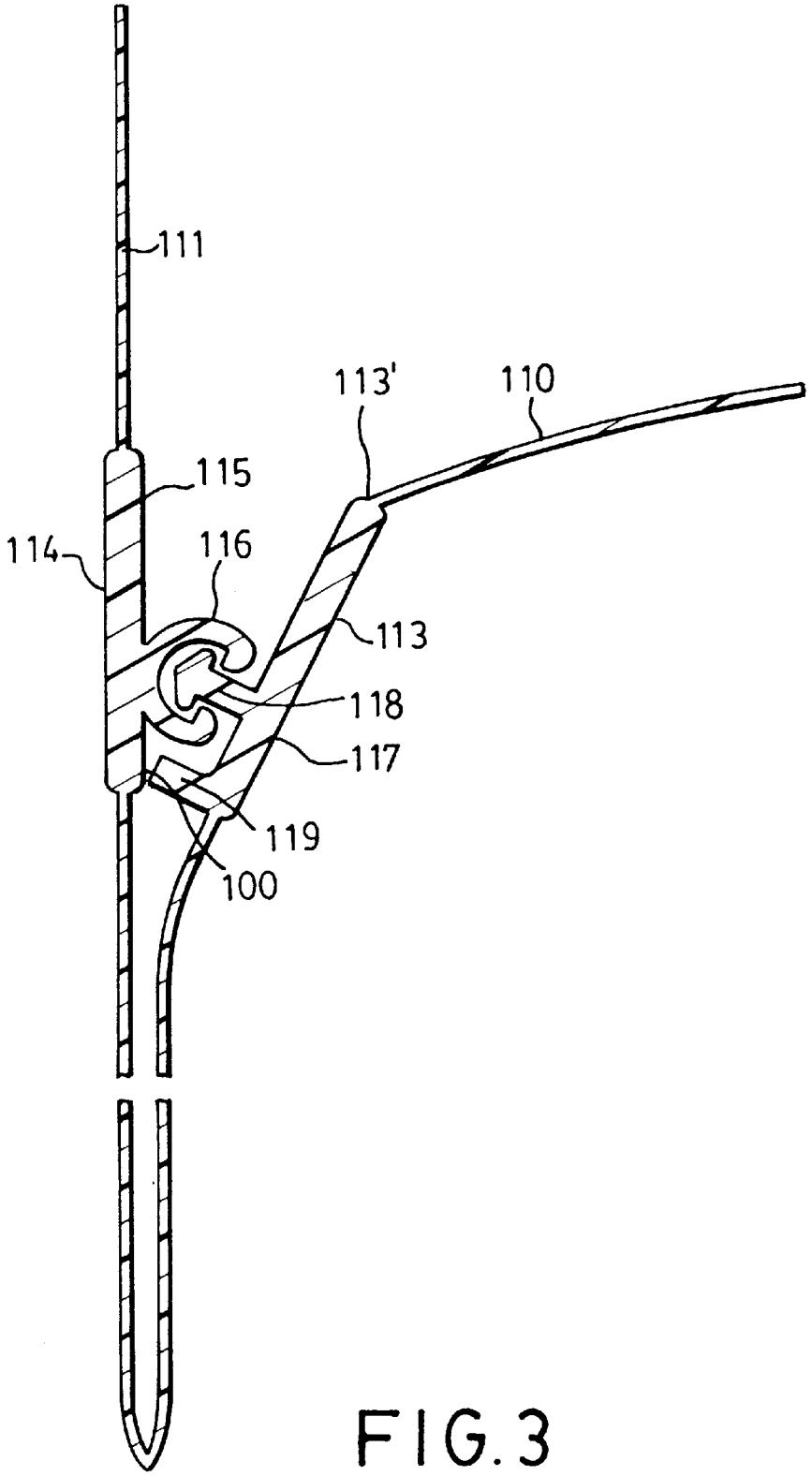
FIG. 3 illustrates the structure of complementary zipper halves of the plastic bag unit according to the first preferred embodiment of the present invention.

As best shown in FIG. 3, each pair of the complementary separable zipper halves includes a male zipper half 113 and a female zipper half 114. In cross-section, the female zipper half 114 has a base 115 which forms a portion of the back wall 111 and which is thicker than the remainder of the back wall 111, and an anchor-receiving member 116 integrally formed with the base 115. The male zipper half 113 has a base 117 which forms a portion of the front wall 110 and which is thicker than the remainder of the front wall 110, an anchor 118 which is complementary with the anchor-receiving member 116 and which extends integrally and perpendicularly from an intermediate portion of the base 117 into the anchor-receiving member 116 of the female zipper half 114, and a fulcrum rib 119 extending integrally and perpendicularly from the lower end of the base 117 to abut against the lower end of the base 115 of the female zipper half 114 along a contacting line 100 on the fulcrum rib 119.

The provision of the fulcrum rib 119 permits rotation of the male zipper half 113 about the contacting line 100 as early as possible when the anchor 118 is removed from the retaining hook 116 of the female zipper half 114. Accordingly, in the present embodiment, the male zipper half 113 has an effect of leverage wherein the distance from the fulcrum rib 119 to the top side 113' of the base 117 of the male zipper half 113, that is, the distance from the fulcrum point to the effort point, is about three times the distance from the fulcrum rib 119 to the anchor 118, that is the distance from the fulcrum point to the resistance point. Thus, only a small force, which is about ⅓ of the engagement force between the zipper halves 113,114, is needed to separate the halves 113, 114 by prying during the disengagement of the male zipper half 113 from the female zipper half 114.

It should be noted that, rotation of the male zipper half 113 about the contacting line 100 when the anchor 118 is removed from the retaining hook 116 of the female zipper half 114 can also be achieved in the absence of the fulcrum rib 119.

It should be noted that the transmission direction of force in a soft plastic film is difficult to control due to its nature. When force is applied onto a soft plastic film, the force is transmitted in the form of a plane, not in the form of a line. Therefore, if only a narrower pathway is maintained in the plane across which the force is transmitted, the transmission direction of force in the plastic film can be controlled since the transmission of force is changed to be in the form of a line, thereby the tensional force of the plastic film can be controlled by the adjustment of the narrower pathway.

Figure 4:
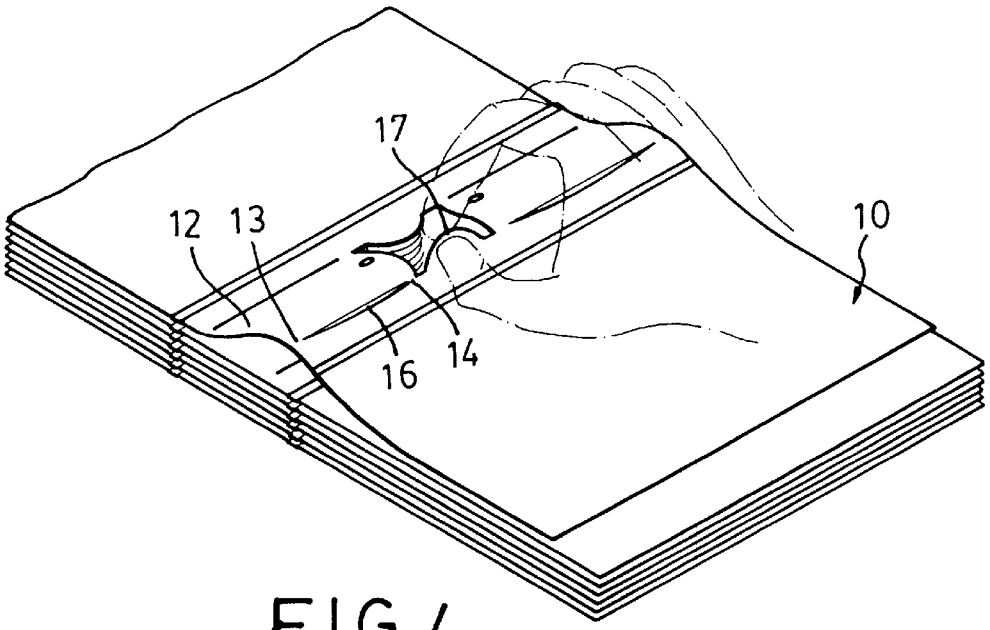
FIGS. 4 and 5 illustrate how an uppermost one of the stacked plastic bags is opened in accordance with the first preferred embodiment of the present invention.

In use, referring to FIG. 4, the lip 17 of the front wall of one of the plastic bags 11 of the uppermost bag unit 10 is held. Before the zipper halves 113,114 are separated, a generally V-shaped fanned-out tension is formed from the zipper halves 113,114 adjacent to the lip 17 that is held to the spacer unit 12 through the inner uncut spaces 14. Then, the lip 17 of the plastic bag 11 is quickly pulled in a direction toward the zipper halves 113,114 in the manner of FIG. 5. As a consequence, the inner uncut spaces 14 interconnecting the spacer unit 12 and the front walls 110 of the plastic bag 11 are broken prior to separation of the zipper halves 113, 114. When the zipper halves 113, 114 begin to separate at the center and further separate toward left and right edges to an extent, the outer uncut spaces 13 interconnecting the spacer unit 12 and the front and back walls 110, 111 of the plastic bag 11 and the inner uncut space 14 interconnecting the spacer unit 12 and the back wall 111 of the plastic bag 11 are broken. At this time, the rigidity of the ziper halves 113, 114 enables the opening 112' which is located between the front and back walls 110,111 above the zipper unit to be kept open, thereby permitting the bag cavity 112 of the plastic bag 11 to be accessible and fillable. Since the lip 17 of the plastic bag 11 is quickly pulled, the zipper halves 113,114 can be separated by the pulling force before the pulling force is transmitted in turn through the zipper half 113 and the zipper half 114 to the uncut space 14 for breaking the same.

It should be noted that, since the tensional force of the inner uncut spaces 14 are equal to or slightly greater than ⅓ of the engagement force between the zipper halves 113,114, according to Newton's first law of motion, when the lip 17 is pulled quickly in the direction toward the zipper halves 113,114, and when the pulling force applied to the lip 17 of the plastic bag 11 is equal to ⅓ of the engagement force between the zipper halves 113,114, the zipper halves 113, 114 are separated before the pulling force applied to the lip 17 of the plastic bag 11 is transmitted to the inner uncut spaces 14 interconnecting the spacer unit 12 and the back wall 111 of the plastic bag 11 via the zipper halves 113,114. Therefore, the zipper halves 113,114 of the plastic bag 11 are ensured to separate before the inner uncut spaces 14 interconnecting the spacer unit 12 and the back wall 111 of the plastic bag 11 are broken.

From the foregoing, it will be appreciated that, since the leverage effect of the male and female zipper halves 113,114 is provided and since the lip 17 of the plastic bag 11 is pulled quickly, the pulling force needed to separate the zipper halves 113,114 is reduced, and the zipper halves 113,114 can be separated by the pulling force before the pulling force is transmitted in turn through the zipper halves 113,114 to the uncut spaces 14 so that the distance between the spacer unit 12 and the zipper halves 113,114 can be reduced as compared with the prior art, thereby resulting in material saving and in reduced manufacturing cost.

It should also be noted that, the purpose of the provision of the outer uncut spaces 13 is to prevent the two sides of the plastic bag 11 from drooping when the width of the plastic bag 11 is relatively large and when the bag units 10 are held on a stand (not shown) as described in the prior art. Therefore, there is no need to provide the outer uncut spaces 13 when the width of the plastic bag 11 is relatively small and/or when the bag units 10 are placed on the worktable, since the provision of the outer uncut spaces 13 has no effect on the tensional force of the inner uncut spaces 14 due to the fact that the outer uncut spaces 13 are located out of the "fanned-out" range of the pulling force applied on the lip 17.

Figure 6:
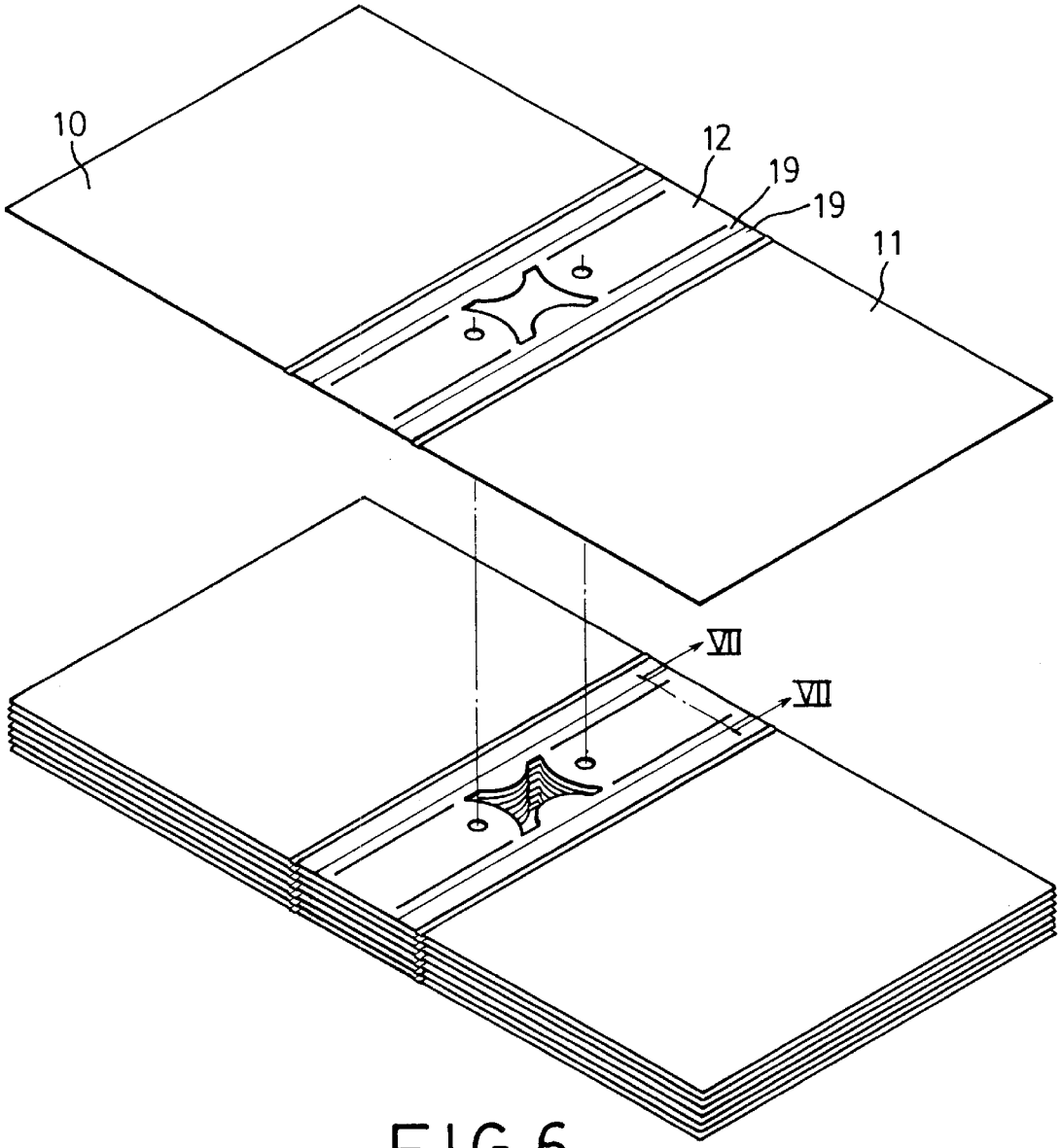
FIG. 6 is a perspective view of a plurality of stacked plastic bag units according to a second preferred embodiment of the present invention.
Figure 7:
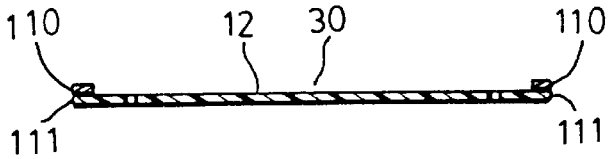
FIG. 7 is a sectional view taken along line VII—VII in FIG. 6.

The first embodiment can be modified into the structure of FIG. 6, in which similar parts are designated by like reference numbers as those in FIG. 1. As shown in FIGS. 6 and 7, this modified embodiment is similar to the previous embodiment in construction except for formation of a cutout 30 in each of the bag units 10. Specifically, each of the spacer units 12 has only one layer which is connected to the back wall 111 of the corresponding plastic bags 11.

Figure 8:
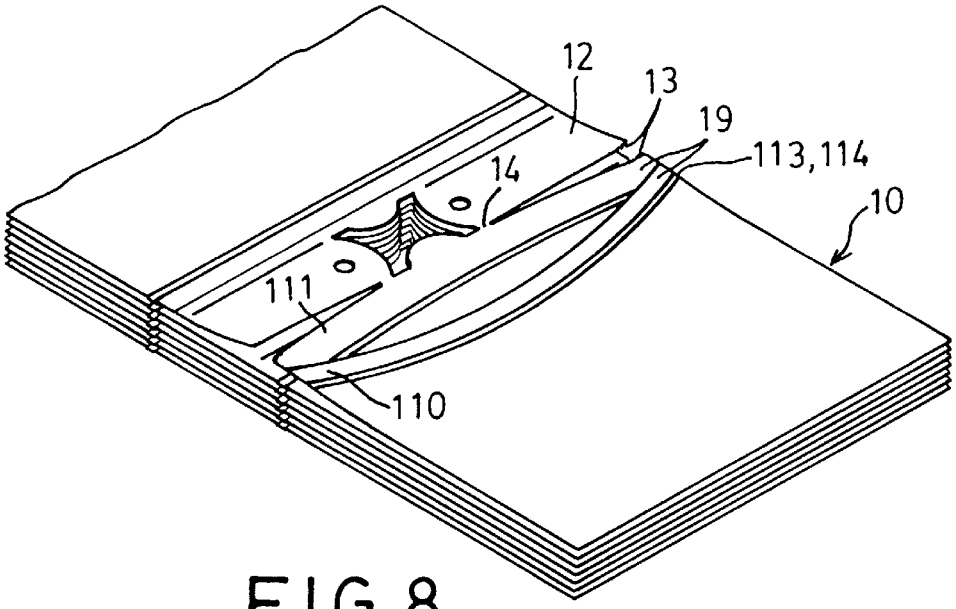
FIG. 8 illustrates how an uppermost one of the stacked plastic bags is opened in accordance with the second preferred embodiment of the present invention.
Figure 9:
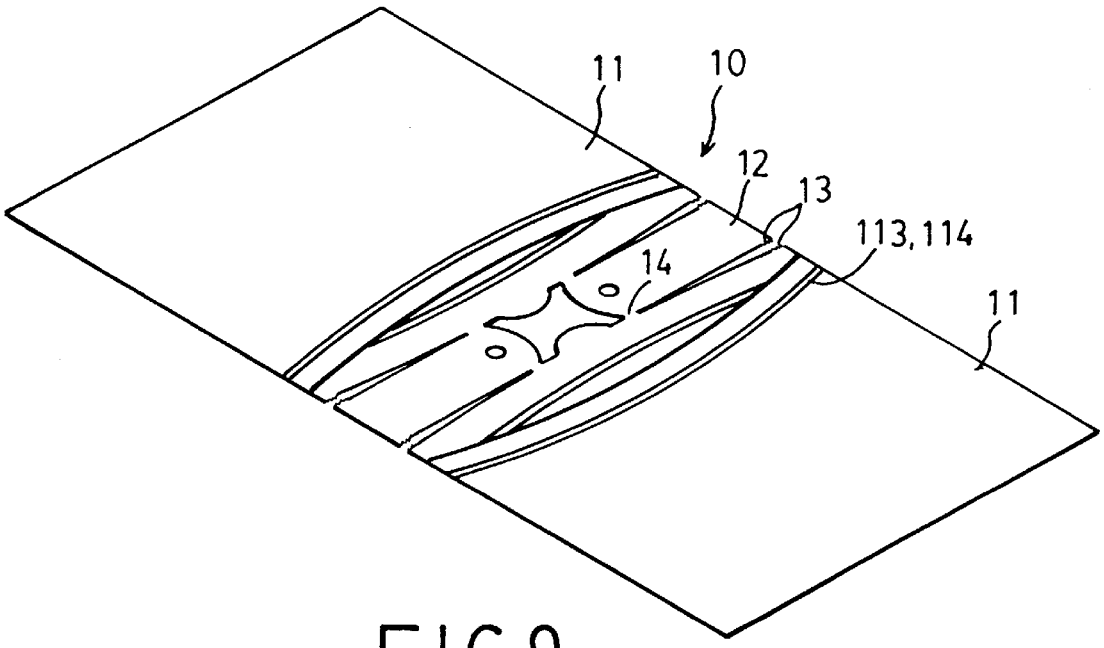
FIG. 9 shows a plastic bag unit according to the second preferred embodiment of the present invention, in which plastic bags have been opened.

In use, referring to FIGS. 8 and 9, the front wall 110 of one of the plastic bags 11 of the uppermost bag unit 10 above the zipper half 113 is held and pulled quickly in the direction toward the zipper halves 113,114 so that the zipper halves 113, 114 are separated firstly. When the zipper halves 113, 114 begin to separate at the center and further separate toward left and right edges to an extent, the outer uncut spaces 13 interconnecting the spacer unit 12 and the back wall 111 of the plastic bag 11 and the inner uncut spaces 14 interconnecting the spacer unit 12 and the back wall 111 of the plastic bag 11 are broken. At this time, the rigidity of the zipper halves 113,114 enables the opening 112' which is located between the front and back walls 110,111 above the zipper unit to be kept open, thereby permitting the bag cavity 112 of the plastic bag 11 to be accessible and fillable. The zipper halves 113,114 can be engaged with each other after the bag cavity 112 of the plastic bag 11 is accessed and filled. Since the front wall 110 of the plastic bag 11 is quickly pulled, the zipper halves 113,114 can be separated by the pulling force before the pulling force is transmitted in turn through the zipper half 113 and the zipper half 114 to the uncut spaces 14 for breaking the same.

It should be appreciated that, in the present invention, the length of each of the inner uncut spaces 14 is selected to be to an extent that the tensional force thereof is equal to or slightly greater than ⅙ of the engagement force between the zipper halves, so that the total tensional force of the two inner uncut spaces 14 is approximately equal to or slightly greater than ⅓ (⅙×2) of the engagement force between the zipper halves 113, 114. Although the engagement force between the zipper halves 113,114 is larger than the tensional force of the two inner uncut spaces 14, the special function of the zipper halves 113,114 provided that the force needed to separate the zipper halves is reduced to about ⅓ of the engagement force between the zipper halves.

Accordingly, the bag unit of the present invention has the following advantages:

1. The bag units that are stacked can be placed on a worktable or the like, thereby eliminating the time required for the placement of the bag units on a stand and the extension of a support peg of the stand through the support holes of the bags as described in the prior art.
2. Since the force needed to separate the zipper halves is reduced to about ⅓ of the engagement force between the zipper halves, the length of each of the inner uncut spaces 14 can be fixed for bags having various width in the case of the separation of zipper halves is ensured to be prior to the removal of the plastic bag from the remaining portion of the bag units, thereby convenienc-ing the manufacture of the bag unit and reducing the manufacturing cost of the same.
3. Since the pulling force is transmitted to the spacer unit 12 through the inner uncut spaces 14, the uncut spaces 13, 14 need not be placed sufficiently high enough with respect to the zipper halves regardless of the width of the plastic bag unit, thereby resulting in a reduction of plastic material and thus reducing the manufacturing cost.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A plurality of stacked quickly accessible and fillable plastic bag units, each of said plastic bag units comprising:

a spacer unit having two layers; and a plastic bag having a front wall and a back wall which are connected to said spacer unit, said front and back walls of said plastic bag being joined together and defining a bag cavity therebetween, said plastic bag further having a pair of complementary separable zipper halves which include a male zipper half provided on one of said front and back walls and a female zipper half provided on the other one of said front and back walls and which are spaced apart from said spacer unit at a predetermined distance, said female zipper half having a base which forms a portion of the other one of said front and back walls of said plastic bag and which is thicker than remaining portion of the other one of said front and back walls of said plastic bag, and an anchor-receiving member integrally formed with said base, said male zipper half having a base which forms a portion of said one of said front and back walls of said plastic bag and which is thicker than remaining portion of said one of said front and back walls of said plastic bag, an anchor which is complementary with said anchor-receiving member and which extends integrally and perpendicularly from an intermediate portion of said base of said male zipper half into said anchor-receiving member of said female zipper half so as to prevent removal of said anchor from said anchor-receiving member, and a fulcrum rib extending integrally and perpendicularly from said base of said male zipper half to abut against a lower end of said base of said female zipper half along a contacting line on said fulcrum rib, thereby permitting rotation of said male zipper half about said contacting line when said anchor disengages from said anchor-receiving member, said fulcrum rib and a top side of said base of said male zipper half cooperatively defining therebetween a distance which is more than two times a distance defined between said fulcrum rib and said anchor so that the force needed to disengage said zipper halves is smaller than the engaging force of said zipper halves; said plastic bag further having an aperture unit formed through an intermediate portion of said spacer unit, two narrower outer uncut spaces which are respectively adjacent to longitudinal sides of said plastic bag and which connect said spacer unit to said front and back walls of said plastic bag, and two wider inner uncut spaces which are respectively adjacent to said aperture unit and which connect said spacer unit to said front and back walls of said plastic bag, the force provided by said uncut spaces being smaller than the engaging force of said zipper halves and being equal to or slightly greater than the disengaging force of said zipper halves, each of said outer uncut spaces and an adjacent said inner uncut space cooperatively defining therebetween a slit line having a length which is longer than those of said inner and outer uncut spaces, said slit lines of said plastic bag being designed so that, upon application of a quick pulling force to a portion of said front wall adjacent to said aperture unit toward said zipper halves, said front wall separates from said spacer unit at said wider inner uncut spaces, thereby subsequently separating said zipper halves from each other and finally separating said plastic bag from said spacer unit along said narrower outer uncut spaces on said front wall and said outer and inner uncut spaces on said back wall.

2. A plurality of stacked quickly accessible and fillable plastic bag units as claimed in claim 1, wherein said front wall of said plastic bag of each of said plastic bag units is integrally formed with a lip which extends into said aperture unit and which serves as said portion of said front wall.

3. A plurality of stacked quickly accessible and fillable plastic bag units, each of said plastic bag units comprising:

a spacer unit; and a plastic bag having a front wall and a back wall which is connected to said spacer unit, said front and back walls of said plastic bag being joined together and defining a bag cavity therebetween, said plastic bag further having a pair of complementary separable zipper halves which include a male zipper half provided on one of said front and back walls and a female zipper half provided on the other one of said front and back walls and which are spaced apart from said spacer unit at a predetermined distance, said female zipper half having a base which forms a portion of the other one of said front and back walls of said plastic bag and which is thicker than remaining portion of the other one of said front and back walls of said plastic bag, and an anchor-receiving member integrally formed with said base, said male zipper half having a base which forms a portion of said one of said front and back walls of said plastic bag and which is thicker than remaining portion of said one of said front and back walls of said plastic bag, an anchor which is complementary with said anchor-receiving member and which extends integrally and perpendicularly from an intermediate portion of said base of said male zipper half into said anchor-receiving member of said female zipper half so as to prevent removal of said anchor from said anchor-receiving member, and a fulcrum rib extending integrally and perpendicularly from said base of said male zipper half to abut against a lower end of said base of said female zipper half along a contacting line on said fulcrum rib, thereby permitting rotation of said male zipper half about said contacting line when said anchor disengages from said anchor-receiving member, said fulcrum rib and a top side of said base of said male zipper half cooperatively defining therebetween a distance which is more than two times a distance defined between said fulcrum rib and said anchor so that the force needed to disengage said zipper halves is smaller than the engaging force of said zipper halves; said plastic bag further having an aperture unit formed through an intermediate portion of said spacer unit, two narrower outer uncut spaces which are respectively adjacent to longitudinal sides of said plastic bag and which connect said spacer unit to said back wall of said plastic bag, and two wider inner uncut spaces which are respectively adjacent to said aperture unit and which connect said spacer unit to said back wall of said plastic bag, the force provided by said uncut spaces being smaller than the engaging force of said zipper halves and being equal to or slightly greater than the disengaging force of said zipper halves, each of said outer uncut spaces and an adjacent said inner uncut space cooperatively defining therebetween a slit line having a length which is longer than those of said inner and outer uncut spaces, said slit lines of said plastic bag being designed so that, upon application of a quick pulling force to a portion of said front wall adjacent to said aperture unit toward said zipper halves, said zipper halves separate from each other and, in turn, said plastic bag separates from said spacer unit along said outer and inner uncut spaces on said back wall.

* * * * *